US005201868A

United States Patent [19]

Johnson

[11] Patent Number: 5,201,868

[45] Date of Patent: Apr. 13, 1993

[54] INSULATED SHIPPING CONTAINER

[75] Inventor: Roberta L. Johnson, Atlanta, Ga.

[73] Assignee: Rock-Tenn Company, Norcross, Ga.

[21] Appl. No.: 644,003

[22] Filed: Jan. 22, 1991

[51] Int. Cl.[5] ..... B65D 5/60; B65D 43/02

[52] U.S. Cl. ..... 220/403; 220/408; 220/410; 229/DIG. 4

[58] Field of Search ..... 220/3.1, 400, 403, 408, 220/410, 429, 470; 428/76, 167; 206/521, 523, 594; 383/4, 110, 75, 120; 229/23 R, DIG. 4

[56] References Cited

U.S. PATENT DOCUMENTS

| | | | |
|---|---|---|---|
| 546,767 | 9/1895 | Knobeloch . | |
| 742,159 | 10/1903 | Burton . | |
| 930,953 | 8/1909 | Freund . | |
| 1,146,307 | 7/1915 | Butler . | |
| 1,264,497 | 4/1918 | Field . | |
| 1,307,638 | 6/1919 | Pridham . | |
| 1,352,833 | 9/1920 | Robinson . | |
| 1,364,839 | 1/1921 | Gereke . | |
| 1,400,060 | 12/1921 | Heim . | |
| 1,704,175 | 3/1929 | Coale . | |
| 2,008,420 | 7/1935 | Howard . | |
| 2,087,966 | 7/1937 | Clark . | |
| 2,307,720 | 1/1943 | Ringler . | |
| 2,456,841 | 12/1948 | Rushing . | |
| 2,556,321 | 6/1951 | Denton . | |
| 2,632,723 | 3/1953 | Bennett . | |
| 2,711,282 | 6/1955 | D'esposito . | |
| 2,770,406 | 11/1956 | Lane . | |
| 2,794,588 | 6/1957 | George et al. | 229/23 R |
| 2,837,261 | 6/1958 | Stenger . | |
| 2,856,114 | 10/1958 | Guyer . | |
| 2,915,235 | 12/1959 | Rueckert . | |
| 2,954,913 | 10/1960 | Rossman . | |
| 2,967,654 | 1/1961 | Palmer . | |
| 2,982,464 | 5/1961 | Wingate . | |
| 3,031,121 | 4/1962 | Chase | 383/110 |
| 3,038,463 | 6/1962 | Daymon . | |
| 3,194,480 | 7/1965 | Maindron . | |
| 3,227,352 | 1/1966 | Striplin et al. . | |
| 3,264,165 | 8/1966 | Stickel | 428/71 |
| 3,306,516 | 2/1967 | Taylor, Jr. . | |
| 3,344,973 | 10/1967 | Studen . | |
| 3,348,756 | 10/1967 | Boysen . | |
| 3,393,859 | 7/1968 | Giummo . | |
| 3,412,521 | 11/1968 | Bowman | 493/100 |
| 3,567,106 | 3/1971 | Anderson . | |
| 3,589,971 | 6/1971 | Reed | 383/110 |
| 3,608,811 | 9/1971 | Frick . | |
| 3,615,149 | 10/1971 | Malone | 220/410 |
| 3,615,964 | 10/1971 | Malone . | |
| 3,627,541 | 12/1971 | Farquhar . | |
| 3,743,169 | 7/1973 | Person . | |
| 3,756,495 | 9/1973 | Bemiss . | |
| 3,779,447 | 12/1973 | Bemiss . | |
| 3,812,002 | 5/1974 | Lurie | 428/167 |
| 3,863,830 | 2/1975 | Christensson . | |
| 3,866,816 | 2/1975 | Bemiss . | |
| 3,883,068 | 5/1975 | Silver . | |
| 3,890,762 | 6/1975 | Ernst et al. . | |
| 3,902,653 | 9/1975 | Persson . | |

(List continued on next page.)

FOREIGN PATENT DOCUMENTS

| | | |
|---|---|---|
| 700533 | of 1962 | Canada . |
| 319252 | 7/1989 | European Pat. Off. . |
| 2530-219-A | of 1983 | France . |
| 1456741 | 3/1974 | United Kingdom . |

*Primary Examiner*—Gary E. Elkins
*Attorney, Agent, or Firm*—Jones & Askew

[57] ABSTRACT

Insulation material is configured to provide improved insulating properties in a shipping container. A first sheet of insulation material is placed along the bottom of a container under the contents of the container. A second sheet of insulation material is configured to have an inverted U-shape and is placed over a bottom half of the container. A top half of the container is then placed over the bottom half such that the legs of the inverted U-shaped material are between the overlapping sides of top and bottom of the container and the middle portion of the U-shaped material is between the top of the container and the contents within the container.

17 Claims, 4 Drawing Sheets

U.S. PATENT DOCUMENTS 3,917,155 11/1975 Bemiss .
3,964,669 6/1976 Sontag et al. .
3,972,467 8/1976 Whillock et al. .
3,990,495 11/1976 Labarba ..... 220/410
4,032,060 6/1977 Bergstein .
4,196,841 4/1980 Smith et al. .
4,196,843 4/1980 Garmon .
4,208,007 6/1980 Bamburg et al. .
4,237,171 12/1980 Laage et al. .
4,254,173 3/1981 Peer, Jr. .
4,335,830 6/1982 Garganese .
4,342,610 8/1982 Ray, Jr. .
4,363,851 12/1982 Mishina et al. .
4,401,706 8/1983 Sovilla .
4,489,112 12/1984 Wise et al. .
4,544,597 10/1985 Peer, Jr. et al. .
4,571,340 2/1986 Ferrante et al. .
4,575,000 3/1986 Gordon et al. .
4,610,885 9/1986 Tait .
4,720,015 1/1988 Brauner .
4,723,700 2/1988 Wischusen, III .
4,730,748 3/1988 Bane .
4,738,545 4/1988 Westgor ..... 383/75
4,754,914 7/1988 Wischusen, III .
4,760,949 8/1988 Elias .
4,777,053 10/1988 Tobelmann et al. .
4,779,998 10/1988 Wischusen, III .
4,867,372 9/1989 Patterson ..... 206/521
5,009,326 4/1991 Reaves et al. ..... 220/410

11'
12
14
16
20
22
30
32
40
42
44
50
52
54
60
62
64
66
70
72
74
76
77
78
80
84

INSULATED SHIPPING CONTAINER

TECHNICAL FIELD

The present invention relates to insulated containers, and more particularly relates to a shipping container providing a configuration for insulation material to provide for improved temperature maintenance of items placed within a container.

BACKGROUND ART

Fresh and frozen food items are shipped worldwide by food suppliers. The fishing industry is one food supplier which ships tremendous quantities of fresh and frozen fish. The fish are often shipped from remote locations in areas such as Alaska to virtually every corner of the world. To preserve the quality of the fish, great care must be taken to avoid spoilage. Warm temperature contributes greatly to spoilage. Salmon in particular is one delicacy which must be handled with great care to preserve its delicate flavor. Thus, in shipping salmon, it is important to maintain frozen fish at a temperature at or below 32° F. and fresh fish at a temperature of between 33° F. and 38° F. It is also important to prevent the fish from either drying out or sitting in water.

Fish are shipped in many types of containers. Many such containers utilize corrugated paperboard in their construction. One version provides a layer of metallized plastic film adhered to the corrugated paperboard. These containers are usually configured to have a top half placed over a bottom half. To help maintain the desired temperature within the container, it is typical for refrigerants such as wet ice, dry ice, or reusable ice packs to be placed within the container. However, even the use of these refrigerants does not consistently maintain the temperature within conventional containers for extended periods of time, such as up to six days under the unrefrigerated conditions often encountered during shipping.

In conventional containers, temperature change is generally attributable to conductive heat transfer between the inner and outer panels of the container, convective air flow into and out of the container, conduction due to condensation formed as the result of ambient air entering the container and contacting the cooler air within the container, and radiant heat transfer. For example, when shipping cold contents, air circulation between the inside of the container and the outside of the container is detrimental to temperature maintenance. Conduction between the inner panels and the outer panels of the container and from condensation can also cause temperature change. In addition to warming both the air and the contents within the container, condensation wets the container material and weakens its structural integrity, degrades the contents, and leaks from the container. Leakage from the container is highly undesirable to air carriers, because the leakage often contains substances corrosive to the airplane. For example, in addition to mess and damage from condensation which is primarily water, the water can also mix with the contents, including salt, blood, and fish slime, to create a highly offensive and corrosive ooze.

It has been suggested to wrap the contents within the container in insulation or to otherwise place insulation within the container to maintain the temperature within the container. This, however, does not inhibit conduction between panels or prevent air from passing into and out of the container. One packaging method uses tape, glue or the like to seal the container such that air is prevented from entering or exiting the container. This, however, does not inhibit conduction between the panels of the container and detracts from the container's ability to be reused. It is also known to provide a metallic or reflective finish on containers to reduce radiant heat transfer. However, these metallic finishes can promote conductive heat transfer if surfaces having a metallic finish are placed in close proximity to other surfaces having a metallic finish.

Thus, there is a need in the art for an improved method for insulating shipping containers and for an improved, reusable insulated shipping container which inhibits the passage of air into and out of the container, inhibits the formation of condensation within the container, prevents liquids from entering into or escaping from the container, decreases conduction between panels of the container, and reduces radiant heat transfer.

SUMMARY OF THE INVENTION

The present invention advances the art by providing an insulated shipping container having improved ability to maintain the temperature of items placed within the container. The present invention minimizes heat transfer by minimizing air and fluid flow between the interior and exterior of the container, by minimizing conduction between components of the container, by reducing the formation of condensation, and by reducing radiant heat transfer.

Generally described, the present invention provides an insulated container including a bottom tray comprising a bottom panel having an upwardly facing inner surface and at least two bottom side panels extending upwardly from the bottom panel, each bottom side panel having an outwardly facing surface; a top cover comprising a top panel having a downwardly facing inner surface and at least two top side panels extending downwardly from the top panel, each top side panel having an inwardly facing surface, the top cover being positioned over the bottom tray such that each inwardly facing surface of the top side panels overlaps and faces one of the outwardly facing surfaces of the bottom side panels, the overlap of the inwardly and the outwardly facing surfaces defining a pair of channels: and an insulating barrier positioned between the channels and below the inner surface of the top panel, comprising two end sections positioned within the channels, and a middle section positioned between the end sections and between the top panel and the interior of the bottom tray.

According to a preferred embodiment, the present invention provides an insulated container comprising a bottom tray having a pair of upwardly extending bottom side panels, each of the bottom side panels defining an outwardly facing surface; a U-shaped insulating barrier, positioned to extend over the bottom tray and downwardly over the outwardly facing surfaces of the bottom tray, and a cover having a pair of downwardly extending cover side panels, each of the cover side panels defining an inwardly facing surface, the cover being positioned over the bottom tray and the barrier such that portions of the barrier are pressed between the cover side panels and the bottom side panels.

Another aspect of the present invention provides an insulated container comprising a bottom tray having at least two bottom side panels; a U-shaped insulating barrier positioned to lie over the bottom tray and along the bottom side panels; and a cover having at least two top side panels, the cover being positioned to retain the barrier between the bottom side panels and the top side panels.

Thus, it is an object of the present invention to provide an improved insulated shipping container.

It is another object of the present invention to provide a shipping container which minimizes heat transfer by minimizing air and fluid flow between the interior and exterior of the container, by minimizing conduction between components of the container, by reducing the formation of condensation, and by reducing radiant heat transfer.

It is yet another object of the present invention to provide an insulated shipping container having a U-shaped blanket positioned between channels formed by overlapping side panels.

Other objects, features, and advantages of the present invention will become apparent upon reading the following specification when taken in conjunction with the drawings and appended claims.

DETAILED DESCRIPTION OF PREFERRED EMBODIMENTS

Figures 1, 2:
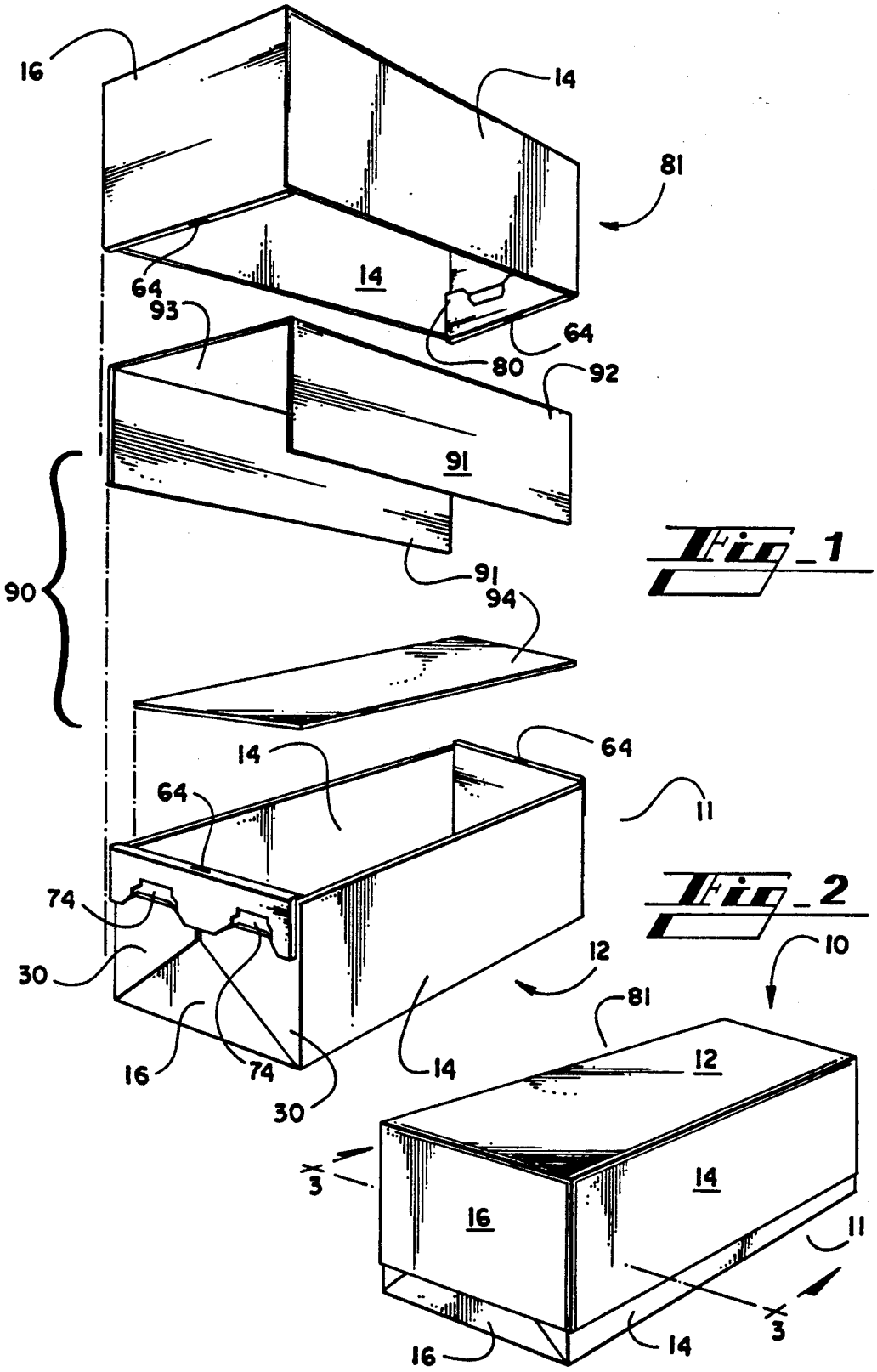
FIG. 1 is a pictorial exploded view of a preferred embodiment of an insulated container according to the invention.
FIG. 2 is a pictorial view of a preferred embodiment of an enclosed insulated container according to the invention.

Referring now in more detail to the drawings, in which like numerals refer to like parts throughout the several views, FIG. 1 is an exploded view of an insulated container 10. The container 10 includes a bottom tray 11, a cover 81, and a two-piece insulating barrier 90 having an interior sheet 94 and a U-shaped blanket 92.

BOTTOM TRAY AND COVER

Figure 6:
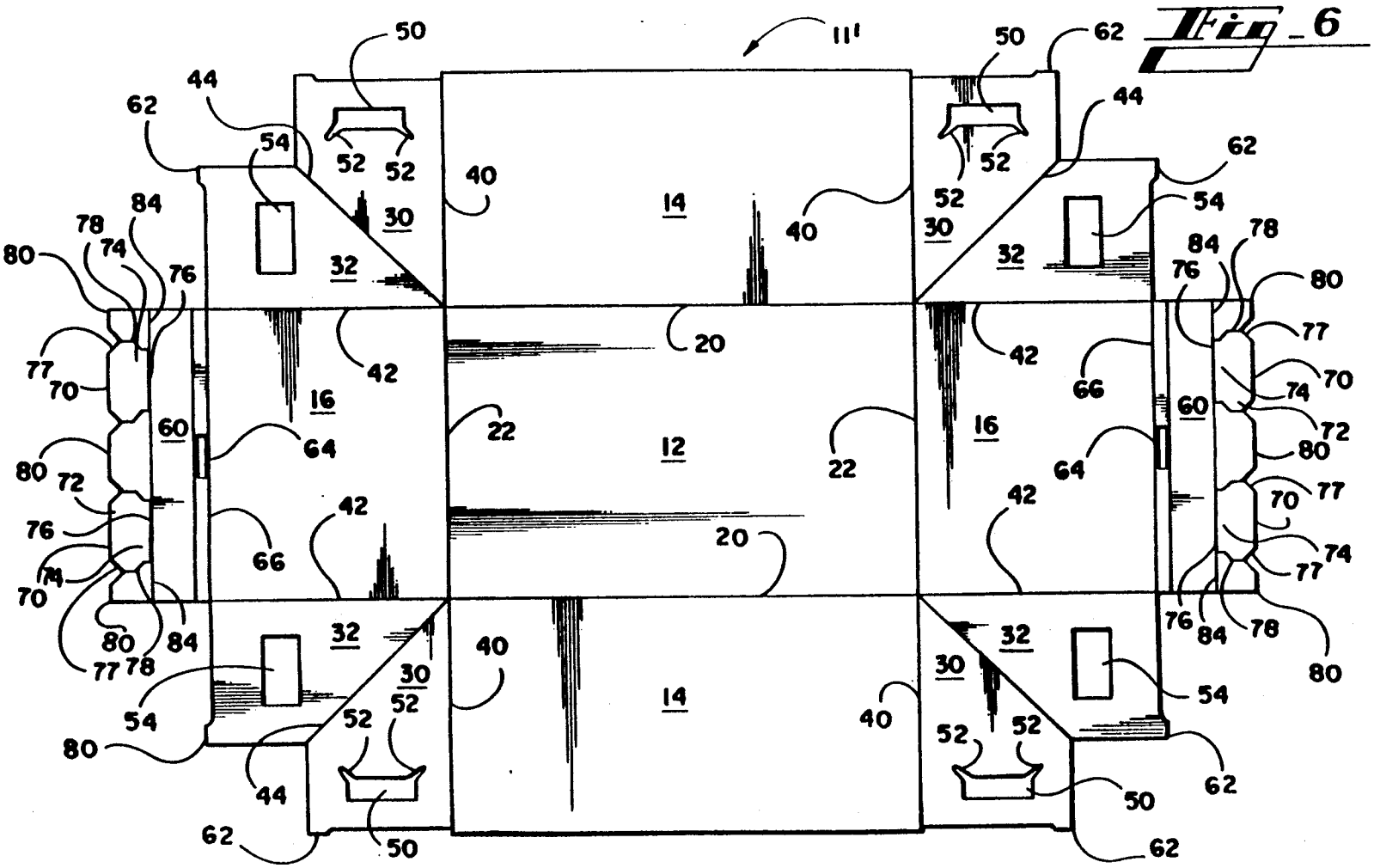
FIG. 6 is a top plan view of a blank used to construct the bottom tray and cover of a preferred embodiment of the invention.

The bottom tray 11 and the cover 81 are preferably constructed such that the assembled container remains assembled independent of secondary securing devices such as tape, glue or twine. The preferred construction is shown in U.S. patent application Ser. No. 449,597, filed Dec. 12, 1989. Referring to FIG. 6, the bottom tray is preferably assembled using a blank 11'. In this preferred construction, the bottom tray includes a bottom panel 12 in the center of the blank 11'. A pair of side panels 14 are foldably connected to opposite sides of the bottom panel 12 along scores or fold lines 20. A pair of end panels 16 are foldably connected to the other opposite sides of the bottom panel 12 along scores 22. A connecting panel 30 is foldably connected along each of a plurality of scores 40 to each end of each of the side panels 14. An additional connecting panel 32 is foldably connected along each of a plurality of scores 42 to each end of each of the end panels 16. Each connecting panel 30 is foldably connected along scores 44 to the connecting panel 32 adjacent to each of the connecting panels 30. A retention tab 62 extends upwardly from each upper edge of the connecting panels 30 and 32 and extends into a retention opening 64 as described below.

Each of the connecting panels 30 defines a first opening 50 therethrough into which a locking tab 70, described below, is inserted. To help each locking tab 70 enter into and be secured within each first opening 50, the first opening 50 is preferably rectangular in shape and defines angled slots 52 extending from the lower corners of the rectangle. Each of the connecting panels 32 defines a second opening 54 therethrough, at least partly overlapping the first opening 50 when the tray 11 is erected. Each second opening 54 is preferably rectangular in shape to provide clearance to help the locking tab 70 slide into the first opening 50.

Extending upwardly from and foldably connected along scores 66 to the upwardly extending edges of each of the end panels 17 is a retention panel 60. Each retention panel 60 is shaped to cover, when the tray 11 is erected, the area of each connecting panel 30 which extends upwardly from the first opening 50 to the upper edge of the connecting panel 30. Each retention panel 60 defines a pair of locking tabs 70, which are slidably inserted into the first openings 50. The locking tabs 70 each have a head portion 72 extending outwardly from a neck portion 74, with the neck portion 74 foldably connected to the outermost horizontal edge of the retention panels 60, along scores 76. The head portion 72 of each locking tab 70 is wider than the first openings 50 and has a plurality of bevelled corners 77 positioned to pass into the slots 52. The head portion 72 also defines a plurality of angled edges 78 positioned to be trapped by the slots 52 when the head portion 72 is inserted into the first opening 50. Each of the scores 66 defines a retention opening 64 along a portion of each of the scores 64, into which the retention tabs 62 extend.

Extending from the retention panels 60 and located adjacent to the locking tabs 70 are tamper tabs 80. The tamper tabs 80 are positioned so that an unexposed surface 82 of each of the tamper tabs 80 faces each of the connecting panels 30 when the tray 11 is erected. The tamper tabs 80 are foldably connected to the retention panels 60 along scores 84.

To assemble the blank 11' into the tray 11, the side panels 14 may be raised relative to the bottom panel 12 by folding about the scores 20. Simultaneously, folds may be made about the scores 22, 40, 42 and 44, raising the connecting panels 30 and 32 and the end panels 16, respectively. As will be apparent to one skilled in the art, folding about the scores 40 and 42 may be made to orientate the connecting panels 30 and 32 either within or exterior to the raised side panels 14 and end panel 16. The connecting panels 30 and 32 may be folded about the scores 46 such that each connecting panel 32 is parallel to and in contact with either the exterior or interior face of each end panel 16. When the connecting panels are positioned exterior to the end panel 16, one face of the connecting panel 30 is parallel to and in contact with the connecting panel 32 and the other face of the connecting panel 30 is exposed. The same folding action brings the retention tabs 62 on adjacent panels 30 and 32 into alignment.

It will be seen that the tray 11 may be formed using locking tabs as described above while utilizing only connecting panels 30, or only connecting panels 32, or a combination thereof. It will further be seen that connecting panels 30 and 32 are not required to be foldably connected along scores 44.

To form the tray 11 the connecting panels are folded exterior to the side and end panels. Then the adjacent connecting panels are folded toward the end panels 16. The connecting panels 32 are then oriented parallel to and in contact with the exterior face of each end panel 16. The retention panels 60 may then be folded about the scores 66 downwards against the connecting panels 30 and 32 with the aligned pairs of retention tabs 62 contained within the retention openings 64. When the retention panels 60 are folded against the connecting panels 30 and 32, the head portion 72 of the locking tabs 70 may be inserted into the first opening 50, so that the bevelled corners 76 pass through the slots 52, and the edges 78 lock in the slots 52. The second opening 54 provides clearance to help the head portion 72 slide into the first opening 50. When fully inserted the locking tabs 70 will remain locked in the slots 52 unless the tabs are manipulated intentionally to allow them to pass back through the slots, which may be done to disassemble the container. When all four locking tabs 70 are inserted into the slots 52, the tray is erected and ready for loading. This locking arrangement not only maintains closure, but also provides a leak proof tray by utilizing seamless construction. The tray 11 may be repeatedly disassembled and assembled.

As will be apparent to one skilled in the art, the retention panels 60 may alternatively be foldably connected to the side panels 14 and the connecting panels 30 and 32 may be folded against the side panels, so that the retention panels fold down over the side panels to allow insertion of the locking tabs 70.

As previously explained, the connecting panels 30 and 32 may be folded against either the interior or exterior of the end panels 16. A container cover 81 shown in FIG. 1 formed in the same manner as the tray 11, is made by positioning the connecting flaps 30 and 32 interior to the side and end panels. The cover 81 may then be placed over the tray 11 and the insulating barrier 90 to form an enclosed container 10 as is shown in FIG. 2, and explained further below. The above steps may be reversed when disassembly is required, with the unassembled blanks being space efficient and readily reassembled.

It is also desirable that a metallized plastic film or foil/plastic laminate layer be disposed on the exterior and interior surfaces of the paperboard blank 11', as is well known in the art. Preferably the plastic surface is positioned to the exterior of the metal layer. However, to avoid metal-to-metal proximity which readily conducts heat between the adjacent components, the metallized layer preferably is not provided for surfaces of the container which immediately abut other similarly prepared surfaces of the container. For example, metallization may be omitted from the inner top sidewall panels and the outer bottom sidewall panels when a metallized blanket (described below) is utilized.

INSULATING BARRIER

Referring to FIG. 1., the preferred two-part insulating barrier 90 includes the blanket 92 comprised of two end sections 91 of insulating material attached to a middle section 93 of insulating material, and the one-piece interior sheet 94 of insulating material. While it is preferred to include sheet 94, the improved thermal integrity of the insulated container 10 is due primarily to the novel placement of the blanket 92 to minimize heat transfer resulting from conduction and convection, as discused below. It will be understood that any insulation material or combination of insulating materials may be used, with the particular material chosen being a function of cost, temperature range, and time.

To install the insulating barrier 90, the interior sheet 94 is placed inside the tray 11 along the bottom panel 12. The blanket 92 is then placed over and around the tray 11, so that the exterior surfaces of the bottom side panels face a side of the U-shaped blanket, as will be discussed further. To form the enclosed container 10, the cover 81 is positioned over the thus assembled tray 11 and insulating barrier 90 such that each outwardly facing surface of the blanket 92 faces an interior surface of the cover 81 and is positioned within a pair of channels 112 defined between these facing surfaces, as shown in FIG. 3.

Turning to the construction of the barrier 90, the three embodiments below provide examples of insulation materials suitable for a wide range of needs. The below descriptions refer to the construction of three embodiments of the blanket 92. It will be understood, however, that similar embodiments of the sheet 94 may be constructed and placed along the bottom of the tray 11 to complete the barrier and provide additional insulation.

Figure 3:
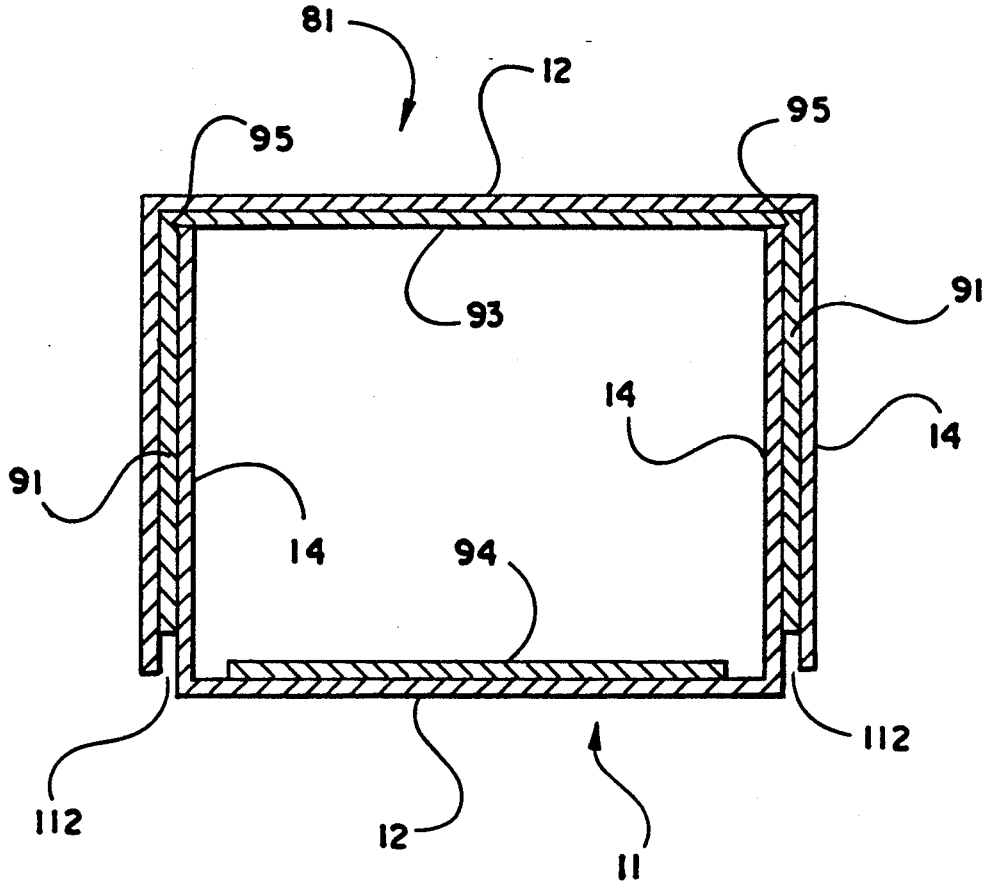
FIG. 3 is a horizontal cross-sectional view of the insulated container taken along line 3—3 of FIG. 2, showing the position of one embodiment of the insulating barrier in the enclosed container of the present invention.

Referring to FIG. 3, there is shown a preferred embodiment of the blanket 92. The blanket 92 is a U-shaped sheet of corrugated board, preferably having a thickness of between one-sixteenth and one-quarter inch and being made of recycled paper materials. The blanket 92 is preferably formed from a one-piece sheet of corrugated board, with fold lines 95, the formation of which are well known in the art, delineating a pair of end sections 91 from a middle section 93 to form the U-shape. To enhance insulating qualities, it will be understood that a metallic or reflective finish may be provided on surfaces of the blanket 92 in the same manner as for the tray 11 and cover 81 to reduce radiant heat transfer, as discussed above. However, if the inner surfaces of the tray and cover are metallized, it is preferable not to metallize the blanket in order to avoid metal-to-metal proximity. An additional improvement conceived by others and included herein as a possible best mode involves the sealing of the flutes of the corrugated board used to form the blanket 92. This aids in preventing air from passing through the flutes and thereby reduces convective heat transfer through the flutes to enhance the insulating capabilities of the corrugated board.

The blanket 92 is shown positioned between the tray 11 and the cover 81, such that the blanket 92 covers the top of the tray 11 and extends into channels 112 formed by the side panels 14 when the cover 81 is placed over the tray 11. Thus, the blanket 92 should be configured to conform closely to the top of the tray 11 and to be pressed between the panels 14 in the channels 112. The sheet 92 of corrugated board is shown positioned along the bottom of the tray 11 to complete the barrier and provide additional insulation.

As shown in FIG. 3, the blanket 92, as installed, substantially occupies the channels 112 and prevents the side panels 14 of the cover 81 from contacting the side panels 14 of the tray 11. In this manner, heat transfer attributable to convection and conduction are minimized.

Convection is the transfer of heat by the circulation of fluids, i.e., such as air flow through the channels 112. Conduction is the transfer of heat between two parts of a stationary system, i.e., such as between the top and bottom side panels 14, caused by a temperature difference between the two parts. Convention is minimized because the blanket 92 effectively blocks air flow through the channels 112 between the interior of the container 10 and the environment. The end panels 16 of the tray 11 and cover 81 are smaller than the side panels 14 and do not provide as large a channel area for convection. Additionally, because of the construction of the end panels 16, they tend to press against one another at the ends, so that air flow is minimal, and additional insulation to protect against convective heat transfer may be omitted.

The blanket 92 also separates the side panels 14 of the tray 11 and the cover 81, and provides a barrier to heat conduction between these panels which could result because of the temperature difference between the interior and exterior of the container. Conduction through the end panels 16 is not a significant problem, primarily because of the small surface area of the end panels and because of dead air space between the end panels 16 of the tray 11 and the cover 81 created by the end construction. Because of these considerations, and to permit the preferred end construction, the end panels 16 of the container are not insulated further. It should be understood however, that the blanket 92 could be extended between the channels formed between the end panels. By minimizing convection and conduction, as described above, condensation is also discouraged from forming.

Figure 4:
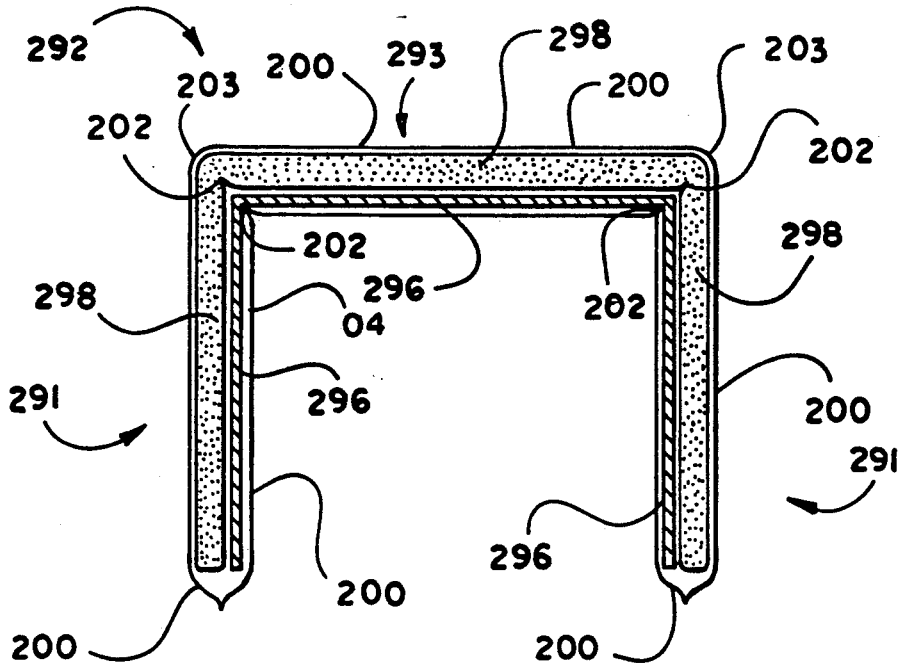
FIG. 4 is a horizontal cross-sectional view of the insulating blanket showing the construction of an alternate embodiment of the insulating material.
Figure 5:
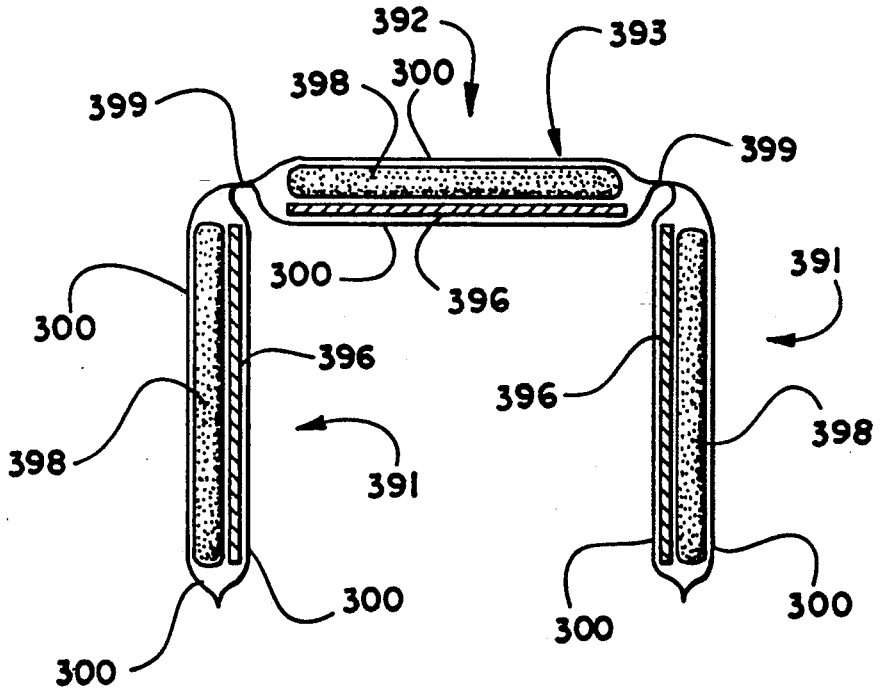
FIG. 5 is a horizontal cross-sectional view of the insulating blanket showing the construction of another alternate embodiment of the insulating material.

The second and third embodiments of the insulating blanket 92, shown in FIGS. 4, and 5, include improvements conceived by others and are disclosed herein as possible best embodiments. These embodiments are installed in the same manner as the blanket 92, but provide a bulkier insulation material which more effectively prevents air flow through the channels 112. These embodiments also provide materials offering a greater degree of protection from heat transfer. Also, as previously discussed, similar embodiments for the sheet 94 may be utilized to provide additional insulation.

As shown in FIG. 4 an alternate embodiment 292 of the blanket 92 may be constructed by sandwiching a stiffener 296 and insulation 298 between a pair of plastic sheets 200. In this embodiment, single sheets of stiffener and insulation are utilized, with the insulation and stiffener being crushed to form scores 202. The plastic sheets are not altered in the area occupied by the scores 202 other than being sealed to one another along their peripheral edges. This provides a vented seam 203 between the end sections 291 and the middle section 293 of the blanket 292. Preferred construction materials are shown in Table 1:

TABLE 1

| Component | Material |
|---|---|
| Stiffener | Paperboard having a thickness between about 6 and 30 mil (between about 6 and 30 point chip board). |
| Insulation | Mineral wool, having a density of between 2.5 and 6.0 pounds per cubic foot and a thickness of between ¼ and 1 and ¼ inch. |

TABLE 1-continued

| Component | Material |
|---|---|
| Plastic sheets | Polyethylene, having a thickness of between 1 and 4 mil; coated with a reflective finish on the exterior surfaces, such as aluminum having a thickness of between 90 and 110 Angstroms applied using a standard technique such as vacuum deposition. |

In this embodiment, the plastic sheets are sealed to one another around their periphery, such as by heat sealing to encase the stiffener and insulation in a single pocket. The stiffener makes a smaller contribution than the mineral wool to the insulation properties of the blanket, adding primarily to the puncture resistance of the blanket and serving to more evenly distribute weight to prevent point compression of the insulator. Additionally, the stiffener may be glued to the insulation, preferably with edible, fast drying, water soluble glues, to improve handling qualities. This construction (not shown) provides a durable material having a high degree of insulation. In addition to the insulating quality of the mineral wool, the scores 202 are held tightly by the cover 81 against the upper edges of the bottom sidewalls 14 of the tray 11. This provides a tight, gasket-like seal along these upper edges of the tray 11 to provide even greater protection from convective heat transfer.

Another alternate embodiment 392 of the blanket 92 is shown in FIG. 5. In this embodiment, the same materials are utilized as those in the alternate embodiment 292 shown in FIG. 4 and Table 1, except that three separate pieces of stiffener 396 and three separate sheets of insulation 398 are utilized. A pair of plastic sheets 300 are sealed around their periphery and along two seams 399 to form a pair of end pouches 391 and a middle pouch 393. A set consisting of a piece of stiffener and a sheet of insulation is inserted into each of the pouches prior to enclosure of the pouches.

This embodiment is more labor intensive than the embodiment shown in FIG. 4 because the individual pieces of stiffener and insulation must be cut and placed within the pouches. Also, the seams 399 must be formed in addition to sealing the plastic sheets around their periphery. However, because the seams 399 are sealed seams, air is not permitted to flow through the individual seams from one section of the blanket to another and thereby convectively transfer heat. Additionally, because the individual pieces of stiffener and insulation are not continuous between the sections of the blanket, heat is restricted from conducting directly through the stiffener and insulation of one section to the stiffener and insulation of another section.

In the embodiments shown in FIGS. 4 and 5, the volume of the blankets 292 and 392 may be reduced by removing air from between the plastic sheets. Removal of the air preferably is accomplished by applying a vacuum between the plastic sheets when sealing the plastic sheets, or by compressing the mineral wool to force out trapped air when sealing the plastic sheets, and allowing the mineral wool to expand once sealing is accomplished.

The foregoing description relates to preferred embodiments of the present invention, and modifications or alterations may be made without departing from the spirit and scope of the invention as defined in the following claims.

I claim:

1. An insulated container, comprising:

a bottom tray comprising:

a bottom panel having an upwardly facing inner surface; and at least two bottom side panels extending upwardly from said bottom panel, each bottom side panel having an outwardly facing surface;

a top cover comprising:

a top panel having a downwardly facing inner surface, and at least two top side panels extending downwardly from said top panel, each top side panel having an inwardly facing surface, said top cover being positioned over said bottom tray such that each inwardly facing surface of said top side panels overlaps and faces one of said outwardly facing surfaces of said bottom side panels, the overlap of said inwardly and said outwardly facing surfaces defining a pair of channels; and an insulating barrier positioned between said channels and below said inner surface of said top panel, comprising two end sections positioned within said channels, and a middle section positioned between said end sections and between said top panel and the interior of said bottom tray.

2. The container of claim 1, wherein said barrier further comprises a sheet of insulating material positioned along said inner surface of said bottom panel.

3. The insulated container of claim 1, wherein said top cover urges said insulating barrier against upwardly facing edges of said bottom side panels.

4. The container of claim 1, wherein said insulating barrier has a reflective finish on at least one surface.

5. An insulated container, comprising:

a bottom tray having a pair of upwardly extending bottom side panels, each of said bottom side panels defining an outwardly facing surface;

a U-shaped insulating barrier, positioned to extend over the bottom tray and downwardly over said outwardly facing surfaces of said bottom tray; and a cover having a pair of downwardly extending cover side panels, each of said cover side panels defining an inwardly facing surface, said cover being positioned over said bottom tray and said barrier such that portions of said barrier are pressed between said cover side panels and said bottom side panels.

6. An insulated container, comprising:

a bottom tray having at least two bottom side panels;

a U-shaped insulating barrier positioned to lie over said bottom tray and along said bottom side panels; and a cover having at least two top side panels, said cover being positioned to retain said barrier between said bottom side panels and said top side panels.

7. The container of claim 6, wherein said U-shaped insulating barrier comprises a sheet material.

8. The container of claim 7, wherein said sheet material is foldable, having a pair of fold lines defined thereon spaced apart by about the distance between said bottom side panels.

9. The container of claim 8, wherein said foldable sheet material is a paperboard sheet.

10. The container of claim 9, wherein said paperboard sheet is a corrugated sheet.

11. The container of claim 10, wherein said corrugated sheet has a reflective finish on at least one of its surfaces.

12. The container of claim 11, wherein said corrugated sheet extends substantially the length and height of the bottom side panels.

13. The container of claim 6, further comprising a bottom sheet of insulating material positioned along an inner surface of said bottom tray.

14. The container of claim 13, wherein said bottom sheet is a paperboard sheet.

15. The container of claim 14, wherein said paperboard sheet is a corrugated sheet.

16. The container of claim 15, wherein said corrugated sheet has a reflective finish on at least one of its surfaces.

17. The container of claim 16, wherein said corrugated sheet extends over substantially all of said inner surface of said bottom tray.

* * * * *